US009718570B1

(12) United States Patent
Ortiz et al.

(10) Patent No.: US 9,718,570 B1
(45) Date of Patent: Aug. 1, 2017

(54) ROBOTIC CARTON ERECTOR AND METHOD OF USE

(71) Applicants: Juan C. Ortiz, Jersey City, NJ (US); Joseph Minond, East Brunswick, NJ (US)

(72) Inventors: Juan C. Ortiz, Jersey City, NJ (US); Joseph Minond, East Brunswick, NJ (US)

(73) Assignee: XPAK USA, LLC, North Brunswick, NJ (US)

( * ) Notice: Subject to any disclaimer, the term of this patent is extended or adjusted under 35 U.S.C. 154(b) by 573 days.

(21) Appl. No.: 14/262,517

(22) Filed: Apr. 25, 2014

(51) Int. Cl.
*B31B 1/78* (2006.01)
*B65B 43/26* (2006.01)

(52) U.S. Cl.
CPC ..... *B65B 43/265* (2013.01)

(58) Field of Classification Search
CPC ..... B65B 43/265; B65B 43/305
USPC ..... 493/309, 311, 313, 314–319
See application file for complete search history.

(56) References Cited

U.S. PATENT DOCUMENTS 2,759,401 A * 8/1956 Tobey ..... B31B 1/78 493/27
3,242,827 A * 3/1966 Winters ..... B65B 43/305 271/132
3,564,980 A * 2/1971 Winters ..... B31B 1/80 493/317
RE27,631 E * 5/1973 Berney ..... B31B 1/00 493/131
4,044,657 A 8/1977 Reichert
4,170,929 A * 10/1979 McDowell ..... B31B 1/80 493/313
4,348,853 A 9/1982 Morse et al.
4,553,954 A * 11/1985 Sewell ..... B31B 1/78 493/122
4,892,513 A 1/1990 Kwiek
5,156,582 A 10/1992 Thompson
5,176,612 A 1/1993 Calvert et al.
5,180,356 A 1/1993 Wakabayashi et al.
5,343,999 A * 9/1994 Yoshida ..... B65G 47/901 198/468.01
5,405,239 A * 4/1995 Calzolari ..... B65B 43/185 198/803.8
5,411,464 A * 5/1995 Calvert ..... B31B 1/80 493/139
5,536,231 A 7/1996 Nilsson
5,924,968 A 7/1999 Odenthal
5,928,123 A * 7/1999 Davis, Jr. ..... B31B 1/80 493/313

(Continued)

FOREIGN PATENT DOCUMENTS

DE 102012001730 A1 * 8/2013 ..... B65B 43/30
FR EP 0202998 A1 * 11/1986 ..... B31B 1/06

*Primary Examiner* — Hemant M Desai
*Assistant Examiner* — Lucas Palmer
(74) *Attorney, Agent, or Firm* — Michael R. Philips

(57) ABSTRACT

A robotic carton erector and method of use is provided by the present invention. The robotic apparatus has a pair of movable jaws with grippers mounted thereto. The apparatus has a rail and a pair of platforms, the platforms positioned downstream of the rail. The robotic apparatus grips and opens a carton and the carton is moved into contact with the rail to close the bottom minor flaps. The carton is moved in a first direction onto a first platform to close a first bottom major flap and in a second direction onto a second platform to close a second bottom major flap. The carton bottom is then sealed.

12 Claims, 4 Drawing Sheets

(56) References Cited

U.S. PATENT DOCUMENTS 6,669,616 B1 * 12/2003 Bierenacki ..... B31B 5/80 493/309
6,764,436 B1 7/2004 Mazurek
6,913,568 B2 7/2005 Frank et al.
7,131,941 B2 * 11/2006 Makar ..... 493/309
7,163,502 B2 1/2007 Fulkerson et al.
7,287,360 B2 * 10/2007 Makar ..... B31B 1/00 53/136.1
7,311,650 B2 * 12/2007 Makar ..... 493/309
7,328,561 B2 2/2008 Fochler
7,510,517 B2 3/2009 Goodman
7,549,277 B2 * 6/2009 Brintazzoli ..... B31B 1/80 53/504
7,819,791 B1 * 10/2010 Ross ..... B31B 3/26 493/121
7,828,708 B2 * 11/2010 Huang ..... B65B 43/265 493/124
8,075,467 B2 12/2011 Monti
8,277,367 B2 10/2012 Jannin et al.
2003/0134733 A1 * 7/2003 Thompson ..... B65B 59/00 493/51
2003/0232709 A1 * 12/2003 Ronchi ..... B65B 43/265 493/309
2004/0110619 A1 * 6/2004 Frank ..... B31B 5/80 493/309
2004/0226270 A1 * 11/2004 Smith ..... B31B 1/80 53/566
2005/0227842 A1 * 10/2005 Brintazzoli ..... B65B 43/265 493/71
2006/0117714 A1 * 6/2006 Draghetti ..... B31B 1/80 53/458
2008/0113856 A1 * 5/2008 Chen ..... 493/313
2009/0093354 A1 * 4/2009 Johnson ..... B65B 43/265 493/52
2013/0036716 A1 * 2/2013 Tsutsumi ..... B65B 43/305 53/564

* cited by examiner

ROBOTIC CARTON ERECTOR AND METHOD OF USE

FIELD OF THE INVENTION

The present invention relates to the field of corrugated carton handling equipment and method of use, and more particularly to an apparatus with a robotic arm drive component for erecting cartons from a flat condition to an open setup condition.

BACKGROUND OF THE INVENTION

Corrugated cartons are used in various manufacturing and distributing plants for packing and shipping goods. The cartons are supplied in flat condition and must be erected, i.e. reconfigured to become open three dimensional containers. The first step in the erecting process is to expand the flat carton to form a tubular three dimensional shape. The second step is to fold the bottom flaps of the carton to hold the intended contents, the first flaps folded being termed minor flaps and the later flaps folded being termed major flaps. The bottom of the erected carton is then fastened closed, e.g. by application of a tape, glue or staples.

Automated equipment for erecting cartons has been available for years. Examples of carton erecting equipment are shown in U.S. Pat. No. 5,156,582 for a Box Erector and U.S. Pat. No. 6,764,436 for a Method And Apparatus For Squaring Cases. Known carton erecting equipment such as these two examples are able to readily erect cartons of singular size and shape. However, the known carton erecting equipment requires time consuming adjustments to be able to handle various carton sizes or styles. In some cases, this modification may be beyond the capability of the machine. It is therefore recognized that a need exists for an automatic apparatus able to erect cartons of various sizes and styles without the need to convert the apparatus.

In a prior response to the need for a size adaptable automatic carton erecting apparatus, U.S. patent application Ser. No. 13/747,880 owned by the same assignee was filed on Jan. 23, 2013. The invention disclosed herein provides a further improvement of the design concepts described and claimed in this prior patent application.

SUMMARY OF THE INVENTION

The robotic carton erector of the present invention is adapted for handling a variety of carton sizes with no need for mechanical adjustments or tool changes. A controllably articulated robotic arm grasps a carton in flat condition and pulls the carton open to a rectangular shape. The robotic arm places the open carton over a curved rail and presses the carton downward to fold the bottom minor flaps into closed condition. The carton is moved laterally with the minor flaps in contact with the rail to move a first of the major flaps across a closing platform, closing the major flap and holding the closed minor flaps in position. The carton is next moved laterally in an opposite direction with the closed major flap and minor flaps held closed to then close the second major flap. Finally, the carton is moved forward across a taping head to seal the carton bottom closed. The carton is now fully erected and ready for being loaded with product.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
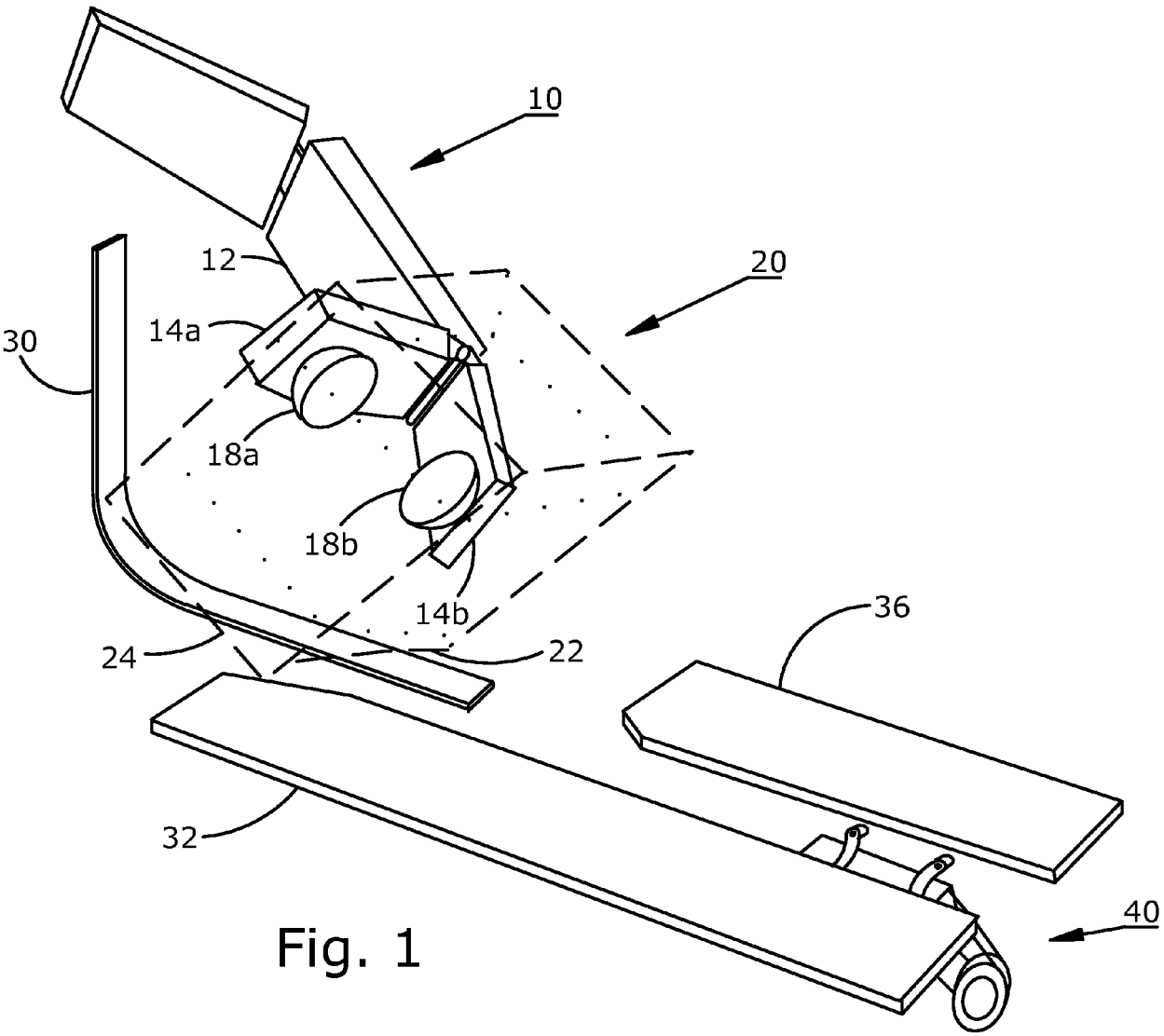
FIG. 1 is a perspective view of the robotic carton erector of the present invention, the carton being shown in dashed lines with score lines shown dotted.

Referring to FIG. 1, an articulated robotic arm 10 is holding a rectangular carton 20 that has been opened into a rectangular tubular configuration. Carton 20 is shown in dashed lines with score lines shown in dotted lines for clarity. A pair of manipulating jaws 14*a*, 14*b* are mounted to an end of a pivoting member 12 and are seen positioned behind carton 20. A first gripper 18*a* is mounted to first jaw 14*a* and a second gripper 18*b* is mounted to second jaw 14*b*, grippers 18*a*, 18*b* preferably being vacuum controllable suction cups. Jaws 14*a*, 14*b* with grippers 18*a*, 18*b* are oriented at an angle of substantially 90° to one another to hold carton 20 open. A front minor flap 22 and a front major flap 24 are seen at the lower end of carton 20. According to conventional terminology, the minor flaps of a carton are folded toward the center first, and the major flaps are folded toward the center of the carton thereafter to cover the minor flaps.

Referring further to FIG. 1, a rail 30 is supported on a frame (not shown) in a position below carton 20 and adjacent to robotic arm 10. Rail 30 has a straight vertical first portion and a straight horizontal last portion that are connected by a curved central portion. Alternately, a substantially straight rail may be provided in horizontal orientation. A platform 32 is supported parallel to rail 30 on one side thereof and a second platform 36 is supported parallel to rail 30 on the opposite side thereof. Platform 32 is positioned partially adjacent to the horizontal portion of rail 30. Platform 36 is positioned beyond the end of rail 30. Platforms 32, 36 are oriented substantially coplanar. A taping device 40 is mounted to reside between the downstream ends of platforms 32 and 36.

Referring further to FIG. 1, robotic arm 10 holds open carton 20 in angular orientation. Subsequently, carton 20 will be moved to contact rail 30 in order to close minor flap 22 and an opposite minor flap (not seen in this view). Carton 20 may be either moved along a downward angle to press both minor flaps into contact with rail 30 substantially at the same time or be moved rearwardly to contact the vertical portion of rail 30 and then downwardly to contact the horizontal portion of rail 30.

Figure 2:
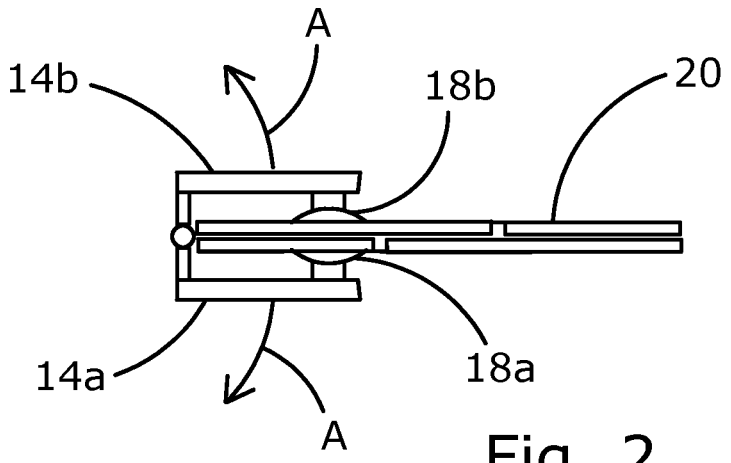
FIG. 2 is a top plan view of a carton in flat condition being gripped by a pair of jaws as utilized herein.

Referring now to FIG. 2, a detail top plan view is shown of jaws 14*a*, 14*b* pressing grippers 18*a*, 18*b* into contact with flat carton 20 prior to opening. As is known, cartons are stored in flat condition to conserve space. As an initial step in the process of carton erecting, and prior to filling, the carton 20 must be expanded to a rectangular tubular shape. Grippers 18*a*, 18*b* are activated. In the preferred embodiment, grippers 18*a*, 18*b* are suction cups and activation involves applying a vacuum to grip carton 20 on each side as shown. Once grippers 18*a*, 18*b* are actively gripping the opposite exterior surfaces of carton 20, jaws 14*a*, 14*b* are extended, i.e. spread, in the directions indicated by arrows A.

Figure 3:
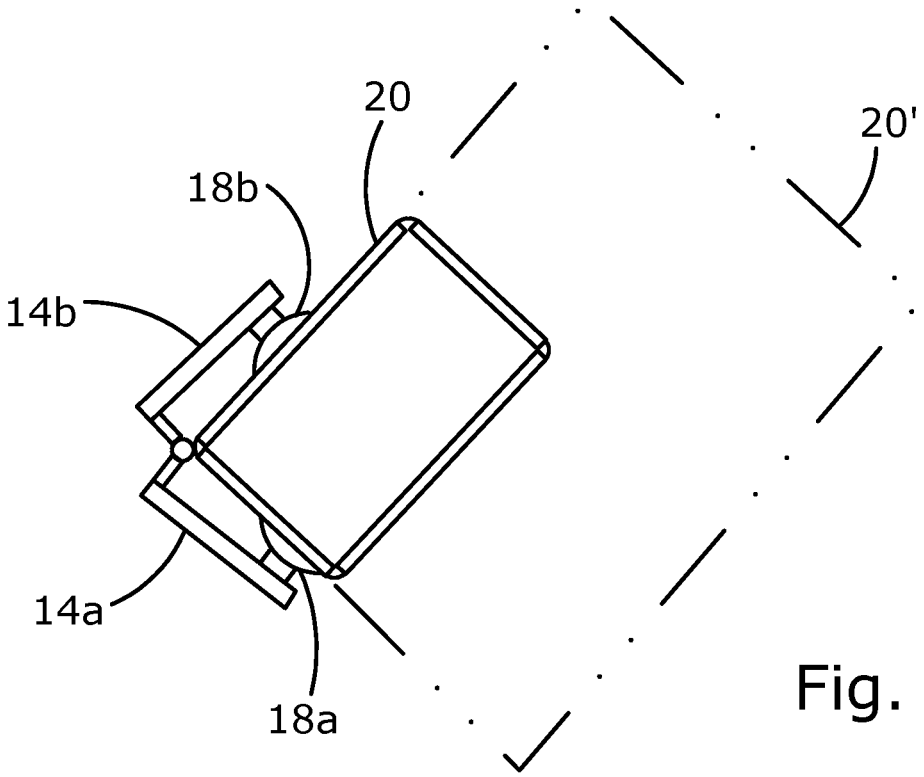
FIG. 3 is a top plan view of the carton of FIG. 2 having been opened by action of the jaws and with an outline of a larger carton shown in dash-dot lines.

Referring now to FIG. 3, jaws 14*a*, 14*b* are oriented substantially at a 90° angle to one another. Carton 20 has been expanded from the flat condition shown in FIG. 2 to a substantially rectangular tube. Whereas conventional carton manufacture involves gluing an overlap portion to form the corrugated sheet into a tube, it is not uncommon for some adhesive to migrate and glue the opposite interior walls of carton 20 together, causing difficulty in opening. The illustrated positioning of jaws 14*a*, 14*b* and grippers 18*a*, 18*b* has been determined to effectively open most cartons, regardless of the two opposite interior walls being glued to one another. However, occasionally the carton interior walls are glued together to a degree that effectively prevents opening without damaging the corrugated board surface. The strength applied to extend jaws 14*a*, 14*b* is calibrated to be less than that which would damage carton 20. Any carton 20 where the adhesion between interior walls is greater than the vacuum strength is automatically rejected and an alternate carton is picked for opening.

Referring further to FIG. 3, an additional benefit of the present invention is depicted. Grippers 18*a*, 18*b* grip the carton being opened at positions adjacent to a common corner, enabling the opening of a variety of carton sizes ranging from a relatively small carton 20 to a relatively large carton 20', the outline of carton 20' being shown in dash-dot lines. Practical limits of carton size handled effectively by the robotic carton erector of the present invention range from 4×4 inches to 24×24 inches. A microprocessor programmed with carton data enables the robotic carton erector to accommodate different size cartons automatically.

Figure 4:
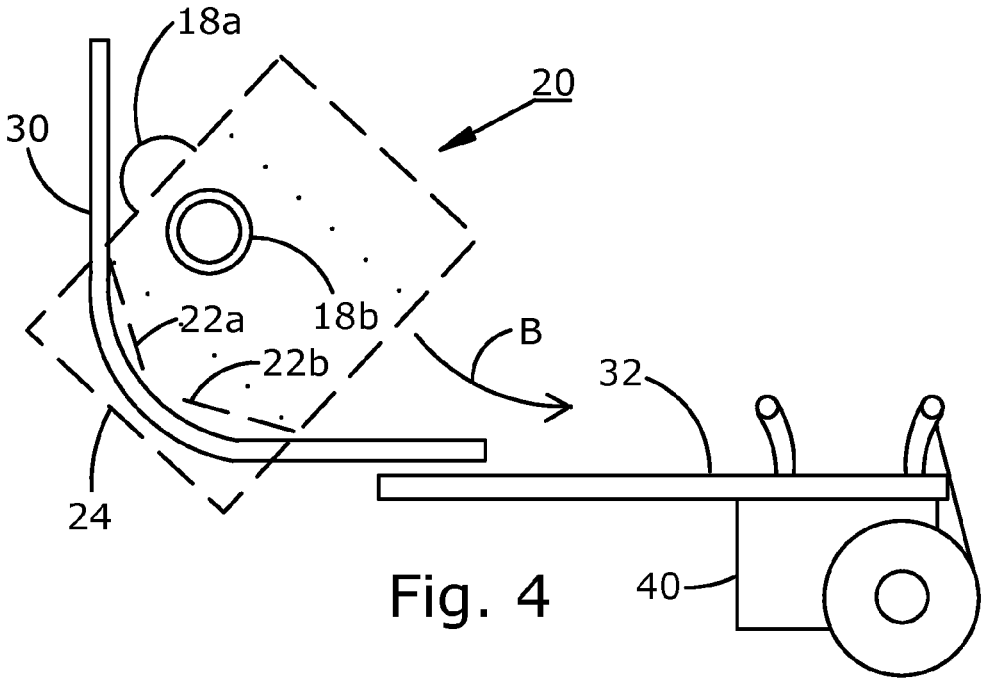
FIG. 4 is a side elevation view of the apparatus of FIG. 1 with a carton in opened condition with the minor flaps partially closed.

Referring now to FIG. 4, the invention is illustrated in side elevation view with a carton 20 pressed angularly downward into rail 30 to cause bottom minor flaps 22*a*, 22*b* to be partially folded. Grippers 18*a*, 18*b* are shown holding carton 20 without showing further mechanics of the robotic arm for reasons of clarity. The robotic arm then moves carton 20 down along the central curved portion of rail 30 in the direction indicated by arrow B, causing bottom minor flaps 22*a*, 22*b* to be pressed upward by the horizontal portion of rail 30, resulting in bottom minor flaps 22*a*, 22*b* becoming fully closed and coplanar. Carton 20 is then moved in a horizontal path of travel along the horizontal portion of rail 30 to engage bottom major flap 24 against platform 32 while rail 30 holds bottom minor flaps 22*a*, 22*b* closed.

Figure 5:
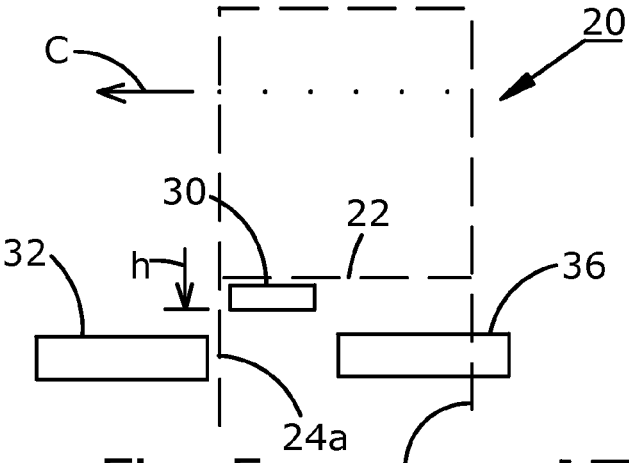
FIG. 5 is a front elevation view of the apparatus of FIG. 1 with the opened carton shown with the minor flaps closed and positioned for closing a first major flap.

Referring now to FIG. 5, the invention is illustrated in end elevation view with carton 20 having the bottom minor flaps coplanar, the bottom minor flaps now identified by numeral 22, and bottom major flaps 24*a*, 24*b* extending vertically downward. Bottom major flap 24*a* resides between rail 30 and platform 32. As shown in FIG. 1, platform 36 is spaced further from the end of rail 30 horizontal portion than platform 32, therefore bottom major flap 24*b* resides behind platform 36. With carton 20 adjacent to platform 32, the robotic arm moves carton 20 in the direction indicated by arrow C to cause bottom major flap 24*a* to be folded into horizontal orientation to essentially lock bottom minor flaps 22 in position. The direction indicated by arrow C is substantially perpendicular to the horizontal portion of rail 30. The top surface of platform 32 is at a height "h" below the bottom surface of rail 30 to allow bottom major flaps 24*a*, 24*b* to be folded upward.

Figure 6:
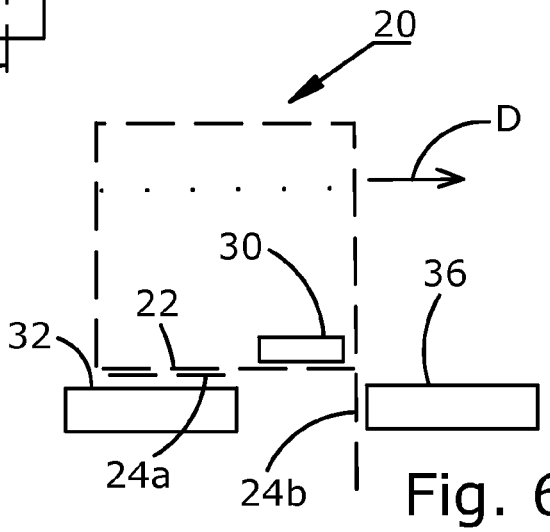
FIG. 6 is a front elevation view of the apparatus of FIG. 1 with the opened carton shown with the minor flaps and a first major flap closed and positioned for closing the second major flap.

Referring now to FIG. 6, carton 20 is shown in the condition effected affected by the action described above with bottom major flap 24*a* being in horizontal orientation and bottom major flap 24*b* in vertical orientation between rail 30 and platform 36. Carton 20 has been moved forward to be beyond the end of rail 30 and adjacent to platform 36. The robotic arm moves carton 20 in the direction indicated by arrow D to cause bottom major flap 24*b* to be folded up to a horizontal orientation on top of platform 36 while maintaining bottom major flap 24*a* in horizontal orientation. The direction indicated by arrow D is substantially perpendicular to the horizontal portion of rail 30 and substantially opposed to the direction indicated by arrow C (see FIG. 5).

Figure 7:
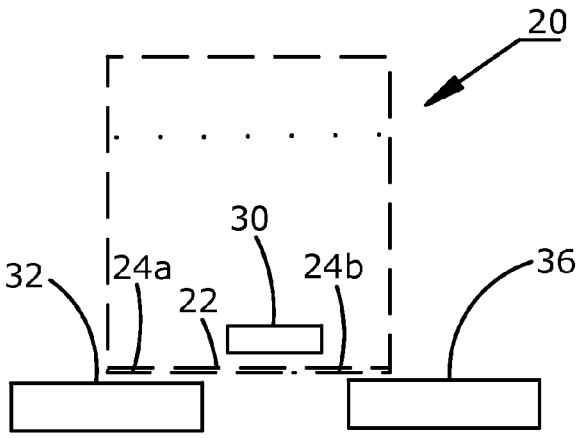
FIG. 7 is a front elevation view of the apparatus of FIG. 1 with the opened carton with the minor and major flaps closed.

Referring now to FIG. 7, carton 20 is illustrated with bottom minor flaps 22 and bottom major flaps 24*a*, 24*b* in fully closed condition. Carton 20 is therefore ready for bottom major flaps 24*a*, 24*b* to be taped or stapled closed.

Figure 8:
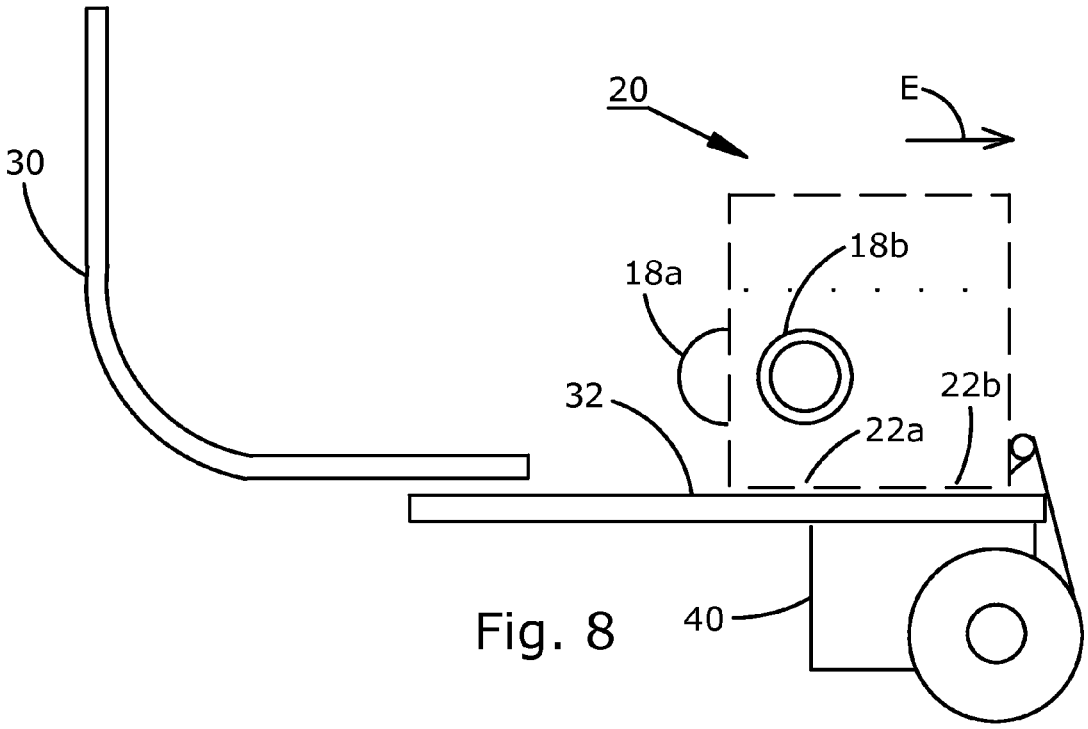
FIG. 8 is a side elevation view of the apparatus of FIG. 1 with the minor and major flaps of the opened carton closed and the carton bottom being taped.

Referring now to FIG. 8, carton 20 is now supported on platform 32 and platform 36 (see FIG. 7). The robotic arm, represented by grippers 18*a*, 18*b*, moves carton 20 in the direction indicated by arrow E to ride over taping head 40 to seal the carton bottom. The upper flaps of carton 20 remain open. Carton 20 is moved further to a filling station or to intermediate storage.

A microprocessor with memory capabilities and an operator interface is built into the robotic carton erecting apparatus. Carton parameters, e.g. box dimensions, are entered into the memory with coded carton designations and motion requirements for full closure. At the start of a production run, an operator inputs a carton code via the interface with direct display on a screen. The robotic arm moves to a supply station where cartons are stacked. The robotic arm grippers descend to the carton stack from above to detect the height of the top box by means of a sensor. The sensor may be of the contact variety or electronic proximity variety. Having determined the height of the top carton and having the thickness of each carton in memory as an input dimension, the robotic arm returns for a second and subsequent cartons to the correct carton height based on calculation, not sensing. This capability allows the robotic carton erector to operate more efficiently.

Therefore, the operational steps for robotically erecting a carton according to the invention disclosed proceed as follows:

a. determining the height location of a first flat carton in a supply stack;

b. picking a flat carton from the supply stack with a pair of grippers;

c. extending the grippers to open the carton to a substantially rectangular tubular condition;

d. moving the open carton to press the bottom minor flaps against a rail, folding the bottom minor flaps upward;

e. moving the carton with bottom minor flaps folded to a first side, folding a first bottom major flap upward against the folded bottom minor flaps;

f. moving the carton with bottom minor flaps and the first bottom major flap folded to a second side, folding a second bottom major flap upward against the folded bottom minor flaps; and g. moving the carton forward to seal the bottom major flaps in closed condition.

While the description above discloses a preferred embodiment of the present invention, it is contemplated that numerous variations and modifications of the invention are possible and are considered to be within the scope of the claims that follow.

What is claimed is:

1. A method for erecting a carton with a robotic carton erector, the method comprising the steps of:

a. picking a flat carton from a supply stack with a pair of grippers that are mounted to an articulating robotic arm;

b. extending the grippers to open the carton to a substantially rectangular tubular condition;

c. moving the open carton to press the bottom minor flaps against a rail and folding the bottom minor flaps upward;

d. moving the carton with the bottom minor flaps folded along a horizontal path of travel;

e. while holding the bottom minor flaps in folded position, moving the carton in a first lateral direction substantially perpendicular to the horizontal path of travel to fold a first bottom major flap upward against the folded bottom minor flaps;

f. while holding the first bottom major flap folded against the folded bottom minor flaps, moving the carton in a second lateral direction substantially perpendicular to the horizontal path of travel and opposite to the first lateral direction to fold a second bottom major flap upward against the folded bottom minor flaps; and g. moving the carton forward along the horizontal path of travel to seal the bottom major flaps in closed condition.

2. The method described in claim 1, further comprising the step of actuating the grippers.

3. The method described in claim 2, wherein the step of actuating the grippers comprises applying a vacuum to the grippers, the grippers being suction cups.

4. The method described in claim 1, further comprising the step of ejecting a flat carton that is unable to be opened without causing damage.

5. The method described in claim 1, further comprising the step of sensing the height of a first carton on a supply stack.

6. The method described in claim 5, further comprising the step of calculating the height of a subsequent carton in the supply stack.

7. A method for erecting a carton with a robotic carton erector, the method comprising the steps of:

a. picking a flat carton from a supply stack with a pair of grippers that are mounted to an articulating robotic arm, the flat carton having a pair of bottom minor flaps and a pair of bottom major flaps;

b. extending the grippers to open the flat carton to a substantially rectangular tubular condition;

c. moving the open carton against a rail having a vertical portion and a hotizontal portion to press the pair of bottom minor flaps upward;

d. moving the carton with the bottom minor flaps folded upward along a linear path of travel;

e. while maintaining the bottom minor flaps in folded position, moving the carton in a first lateral direction to contact a first platform and fold a first bottom major flap upward against the folded bottom minor flaps;

f. while holding the first bottom major flap folded against the folded bottom minor flaps, moving the carton in a second lateral direction opposite to the first lateral direction to contact a second platform and fold a second bottom major flap upward against the folded bottom minor flaps; and g. moving the carton forward to seal the bottom major flaps in closed condition.

8. The method described in claim 7, further comprising the step of actuating the grippers.

9. The method described in claim 8, wherein the step of actuating the grippers comprises applying a vacuum to the grippers, the grippers being suction cups.

10. The method described in claim 7, further comprising the step of ejecting a flat carton that is unable to be opened without causing damage.

11. The method described in claim 7, further comprising the step of sensing the height of a first carton on a supply stack.

12. The method described in claim 11, further comprising the step of calculating the height of a subsequent carton in the supply stack.

* * * * *